US010352022B2

(12) United States Patent
Hunt

(10) Patent No.: US 10,352,022 B2
(45) Date of Patent: Jul. 16, 2019

(54) SECTIONAL GRADER SYSTEM FOR A MOLD BOARD

(71) Applicant: VALLEY BLADES LIMITED, Waterloo (CA)

(72) Inventor: Brad Hunt, Waterloo (CA)

(73) Assignee: Valley Blades Limited, Waterloo, Ontario (CA)

( * ) Notice: Subject to any disclaimer, the term of this patent is extended or adjusted under 35 U.S.C. 154(b) by 71 days.

(21) Appl. No.: 15/555,101

(22) PCT Filed: Mar. 2, 2016

(86) PCT No.: PCT/CA2016/050222

§ 371 (c)(1),
(2) Date: Sep. 1, 2017

(87) PCT Pub. No.: WO2016/138586

PCT Pub. Date: Sep. 9, 2016

(65) Prior Publication Data

US 2018/0038065 A1 Feb. 8, 2018

Related U.S. Application Data

(60) Provisional application No. 62/126,801, filed on Mar. 2, 2015.

(51) Int. Cl.
*E02F 3/815* (2006.01)
*E02F 9/28* (2006.01)

(52) U.S. Cl.
CPC ..... *E02F 3/8152* (2013.01); *E02F 9/2825* (2013.01); *E02F 9/2833* (2013.01); *E02F 9/2841* (2013.01)

(58) Field of Classification Search
CPC ..... F16B 2005/0678; F16B 5/0024; F16B 5/0088; F16B 5/121; Y10T 403/57;
(Continued)

(56) References Cited

U.S. PATENT DOCUMENTS 2,710,180 A * 6/1955 Graham ..... E21C 25/62 125/40
3,152,411 A * 10/1964 Wood ..... E02F 3/8152 172/701.3

(Continued)

FOREIGN PATENT DOCUMENTS

DE 202014105508 U1 * 3/2015

OTHER PUBLICATIONS

International Search Report in relation to corresponding Patent Cooperation Treaty PCT/CA2016/050222, dated Apr. 27, 2016.

(Continued)

*Primary Examiner* — Tara Mayo-Pinnock
(74) *Attorney, Agent, or Firm* — Lorelei G. Graham

(57) ABSTRACT

A sectional grader system for a mold board that includes a plurality of abutting grader segments for detachable connection to the mold board. Each grader segment includes a front face, a back face, a first bolt hole aperture, a right edge having a first recessed section, a left edge having a second recessed section, and a lower edge having a plurality of spaced sockets. The first recessed section may be adapted to accommodate a first portion of a second bolt hole aperture. The second recessed section of an adjacent grader segment may be adapted to accommodate a second portion of the second bolt hole aperture. The sectional grader system may further include a bridge segment adapted to engage the first recessed section and the second recessed section of the adjacent grader segment in flush mount. The bridge segment may have a third bolt hole aperture whereby the third bolt hole aperture aligns with the first and second portions of the second bolt hole aperture for receiving a bolt connector for mounting the plurality of grader segments to the mold board.

16 Claims, 19 Drawing Sheets

(58) Field of Classification Search
CPC ..... Y10T 403/5741; Y10T 403/66; E02F 3/8152; E02F 9/2825; E02F 9/2833; E02F 9/2841
USPC ..... 403/293, 300, 306, 341; 172/701.1–701.3, 719, 772, 772.5
See application file for complete search history.

(56) References Cited

U.S. PATENT DOCUMENTS 4,017,948 A * 4/1977 Vogelbacher ..... D03C 9/0633 28/205
4,299,424 A 11/1981 Lebegue et al.
4,661,008 A * 4/1987 Norihiro ..... E02B 5/00 403/294
4,753,299 A 6/1988 Meyers
4,883,129 A 11/1989 Lonn et al.
5,224,555 A 7/1993 Bain et al.
6,799,388 B2 10/2004 Weaver et al.
7,874,085 B1 * 1/2011 Winter ..... E01H 5/061 172/701.3
8,443,911 B2 5/2013 Tutschek et al.
9,163,379 B2 * 10/2015 Winter ..... E01H 5/061
2012/0151745 A1 * 6/2012 Kuntz ..... E04C 2/423 29/525.01

OTHER PUBLICATIONS

CIPO Examination Notes in relation to corresponding PCT/CA2016/050222.
Written Opinion of the International Searching Authority in relation to corresponding Patent Cooperation Treaty PCT/CA2016/050222, completion of opinion on Apr. 26, 2016, dated Apr. 27, 2016.
International Preliminary Report on Patentability in relation to corresponding PCT/CA2016/050222, dated Sep. 5, 2015.

* cited by examiner

SECTIONAL GRADER SYSTEM FOR A MOLD BOARD

FIELD OF THE INVENTION

This invention relates in general to edge attachment assemblies for a engaging a surface and more particularly to a sectional grader system for a mold board mounted to a surface engaging machine.

BACKGROUND OF THE INVENTION

Surface engaging machines such as earth and road working machines, namely road graders, are used primarily to maintain or create a desired ground surface. Grader machines are subjected to extensive vibration, impact, and abrasive action, resulting from the scraping action between the cutting edge of the blade and the roadbed over which the machine travels.

The surface engaging machine typically employs a large generally horizontal blade to work the ground surface as needed. The large blade is generally made up of a blade mounted on the lower edge of the mold board, which sustains the principle of wear and abrasion. The mold board can further include some sort of cutting tool or cutting edge to etch the ground as the machine performs a scraping-grading type action.

As can be appreciated, such an operation subjects the mold board and the associated cutting tools to harsh treatment resulting in premature wearing and destruction of the mold board and cutting tools.

Efforts to protect the mold board from wear and alternatives to cutting tools include bolting an elongated blade member in increments across the entire lower edge of the mold board. With this construction, the blade forms a continuous working edge which engages the ground surface and protects the mold board. Worn blades are then replaced instead of the much more costly mold board.

Another alternative includes the use of the blade member along with a plurality of picks. The picks, teeth or cutting tools are generally attached to a holder or holder blade which in turn is bolted to the mold board to form a working edge for engaging the ground surface. In order to increase the useful life of the cutting tool, its working tip is often provided with a hardened insert to form the leading surface. The inserts, however, typically wear out quickly or the whole cutting tool is often lost.

Furthermore blade members are often over 14 foot long hardened steel structures that are very heavy and are susceptible to a short wear life due to their ongoing abrasive wear with the ground. Blade replacement can be time consuming particularly where the attachment bolts are bent or frozen, and relatively dangerous due to the size and weight of the blade segments with installed tools, making them very difficult to manhandle. Changing a set of segments is often a two-man operation. As such the harsh environment not only results in higher maintenance and repair costs, but also increased down time for the machine.

Thus a sectional grader system for a mold board which is sectional and allows for easy and accurate installation with removable cutting tools and may be installed safely by a single person is desirable.

SUMMARY OF THE INVENTION

An object of one aspect of the present invention is to provide an improved sectional grader system for a mold board.

In accordance with one aspect of the present invention there is provided a sectional grader system for a mold board that includes a plurality of abutting grader segments for detachable connection to the mold board. Each grader segment includes a front face, a back face, a first bolt hole aperture, a right edge having a first recessed section, a left edge having a second recessed section, and a lower edge having a plurality of spaced sockets.

The first recessed section may be adapted to accommodate a first portion of a second bolt hole aperture. The second recessed section of an adjacent grader segment may be adapted to accommodate a second portion of the second bolt hole aperture. The sectional grader system may further include a bridge segment adapted to engage the first recessed section and the second recessed section of the adjacent grader segment in flush mount. The bridge segment may have a third bolt hole aperture whereby the third bolt hole aperture aligns with the first and second portions of the second bolt hole aperture for receiving a bolt connector for mounting the plurality of grader segments to the mold board.

Conveniently, the sectional grader system may be forged, cast, fabricated or machined by way of example only, in one piece and include a hardened surface and additional wear edge so as to reduce pitting on the surface of the segments.

Preferably, the bridge segment may be further defined as having tapered sides which correspond to tapered sides of the first and second portions of the second bolt hole aperture to ensure the proper alignment of the bridge segment.

In accordance with another aspect of the present invention there is provided a sectional grader system for a mold board that includes a plurality of abutting grader segments for detachable connection to the mold board. Each grader segment includes a front face, a back face, a first bolt hole aperture, a right edge having a first recessed section, a left edge having a second recessed section, and a lower edge having a plurality of spaced sockets.

The first recessed section may be adapted to accommodate a first portion of a second bolt hole aperture. The second recessed section of an adjacent grader segment may be adapted to accommodate a second portion of the second bolt hole aperture. The sectional grader system may further include a bridge segment adapted to engage the first recessed section and the second recessed section of the adjacent grader segment in flush mount. The bridge segment may have a third bolt hole aperture whereby the third bolt hole aperture aligns with the first and second portions of the second bolt hole aperture for receiving a bolt connector for mounting the plurality of grader segments to the mold board.

The sectional grader system further includes a plurality of removable, cutting tools each adapted engage a respective socket. Each cutting tool may have a body portion with an upper end having spring fit retention means for releasably retaining the body portion, and a lower cutting tip for engaging a surface.

In accordance with another aspect of the present invention there is provided a sectional grader system for a mold board that includes a plurality of abutting grader segments for detachable connection to the mold board. Each grader segment includes a front face, a back face, a first bolt hole aperture, a right edge having a first recessed section, a left edge having a second recessed section, and a lower edge having a plurality of spaced sockets.

The first recessed section may be adapted to accommodate a first portion of a second bolt hole aperture. The second recessed section of an adjacent grader segment may be adapted to accommodate a second portion of the second bolt hole aperture. The sectional grader system may further include a bridge segment adapted to engage the first recessed section and the second recessed section of the adjacent grader segment in flush mount. The bridge segment may have a third bolt hole aperture whereby the third bolt hole aperture aligns with the first and second portions of the second bolt hole aperture for receiving a bolt connector for mounting the plurality of grader segments to the mold board.

The sectional grader system further includes a plurality of removable, cutting tools each adapted engage a respective socket. Each cutting tool may have a body portion including a tapered diameter and a threaded upper end adapted to pass through the lower edge of the grader segment to the back face for releasable securement with a fastener, and a lower cutting end for engaging a surface.

In accordance with another aspect of the present invention there is provided a cutting tool for a grader segment for a mold board including a body portion having a tapered diameter to a threaded upper end adapted to pass through a lower edge of a tapered socket or aperture in the grader segment to a back face of the grader segment. The cutting tool may be releasable secured to the grader segment with a fastener, and a lower cutting end for engaging a surface.

Advantages of the present invention include the ability for individual or small sectional replacement, has recessed elements allowing for a smooth, flush mounting, reduces overall aggregate wear, easy and cost effective replacement of cutting tools, and provides an even cutting tool engagement with the surface.

BRIEF DESCRIPTION OF THE DRAWINGS

A detailed description of the preferred embodiments is provided herein below by way of example only and with reference to the following drawings, in which.

Figure 1:
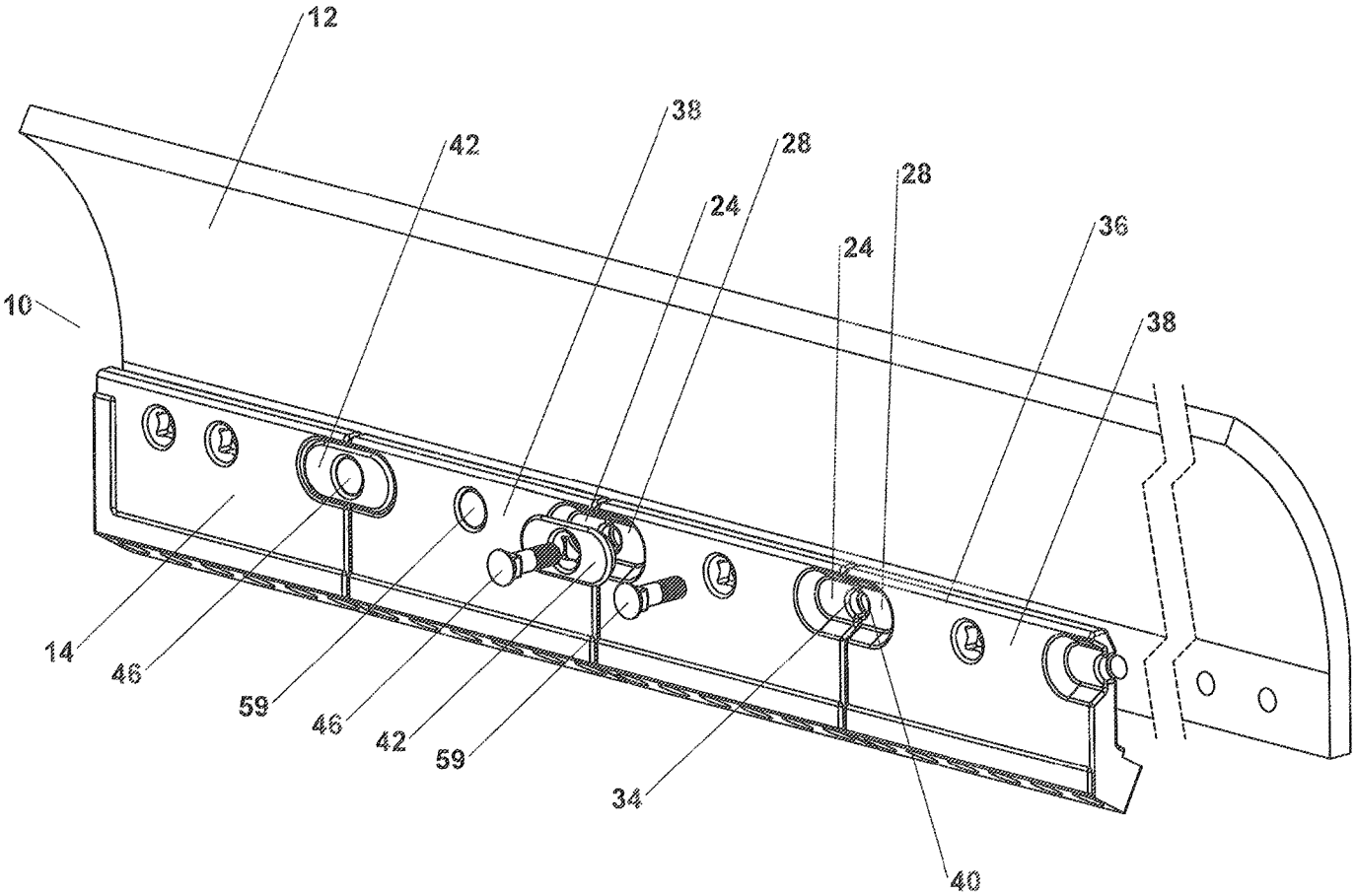
FIG. 1 in a perspective exploded view, illustrates a sectional grader system for a mold board in accordance with a preferred embodiment of the present invention.
Figure 2:
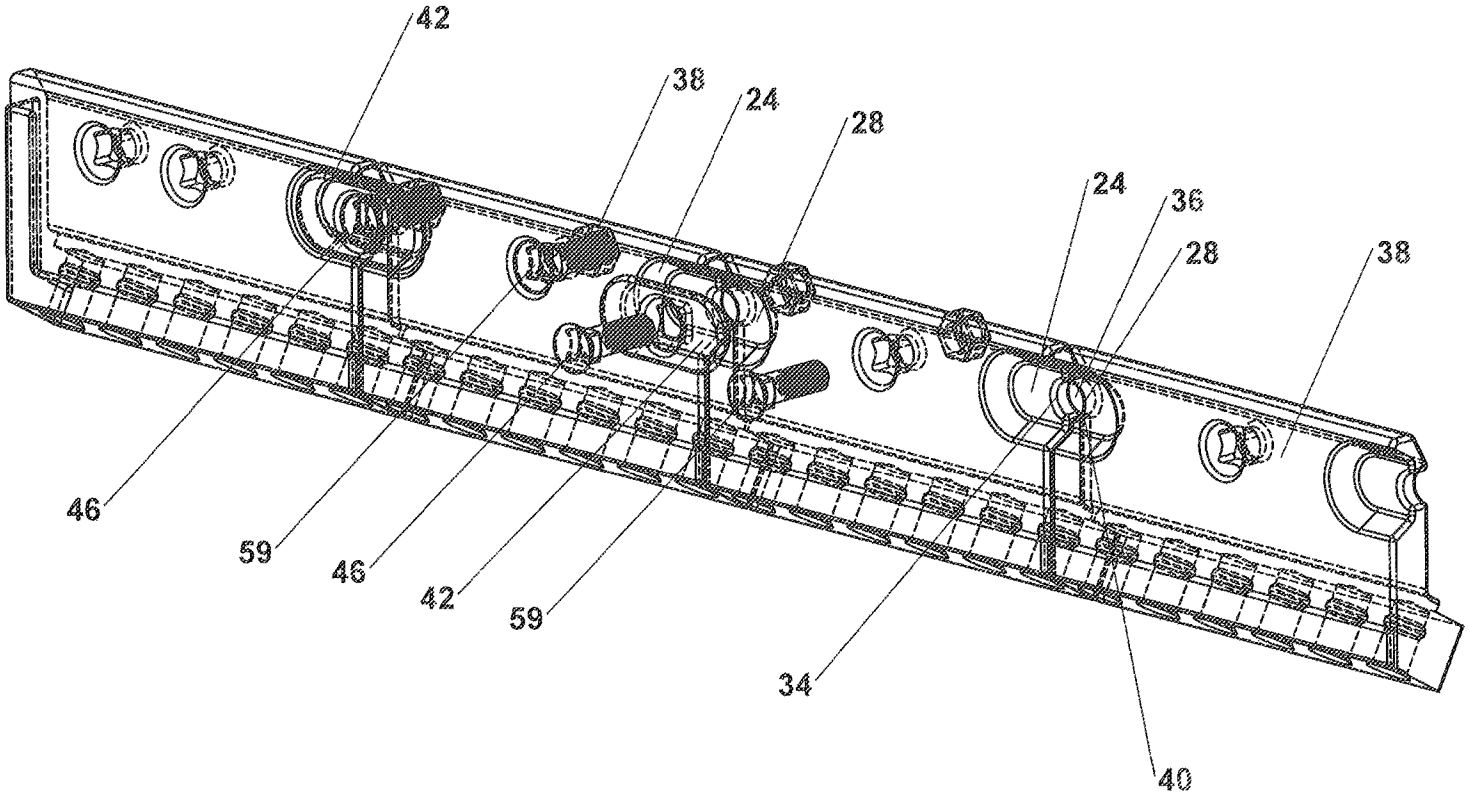
FIG. 2 in a perspective exploded view, illustrates the sectional grader system of FIG. 1.
Figure 3:
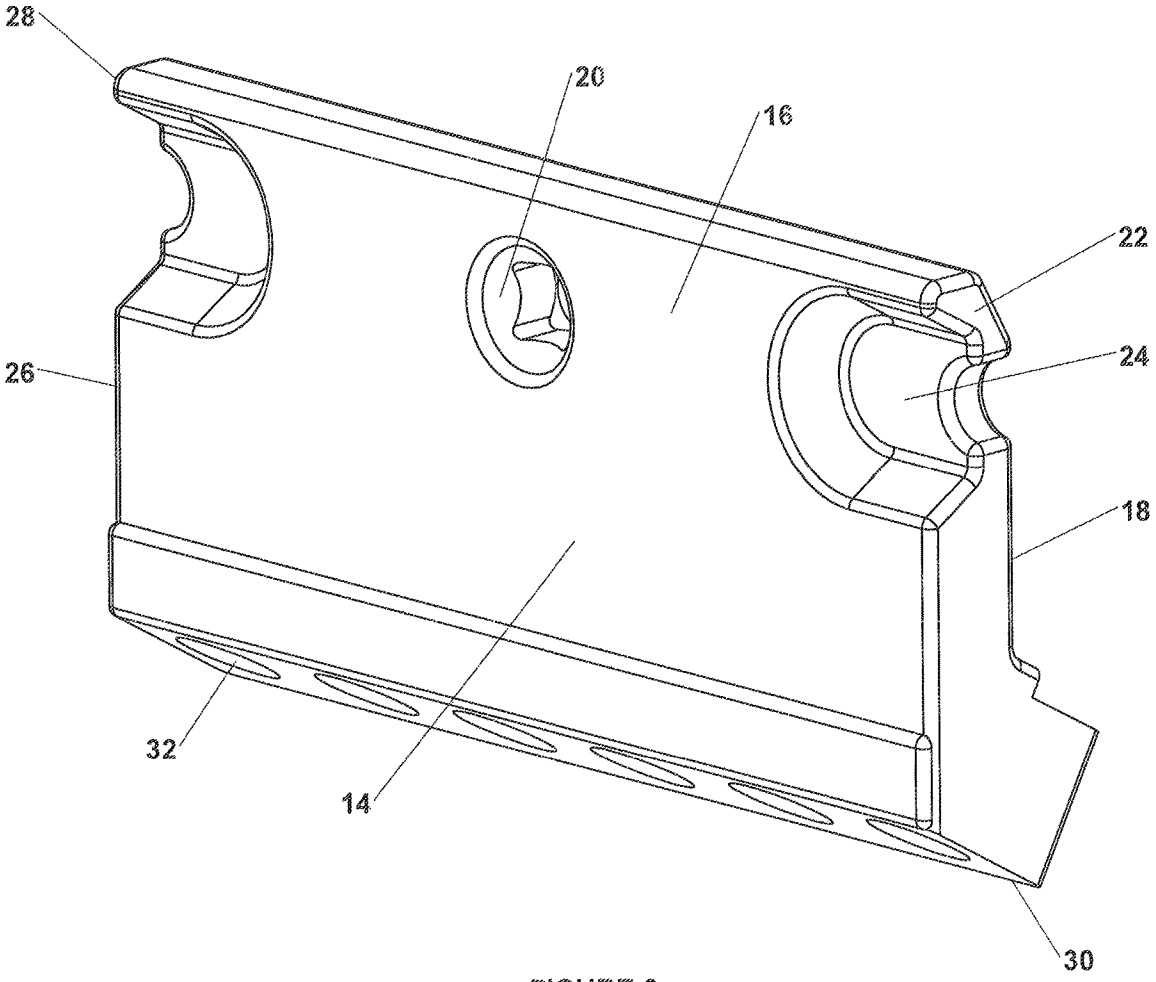
FIG. 3 in a perspective view, illustrates the grader segment of the sectional grader system of FIG. 1.
Figure 4:
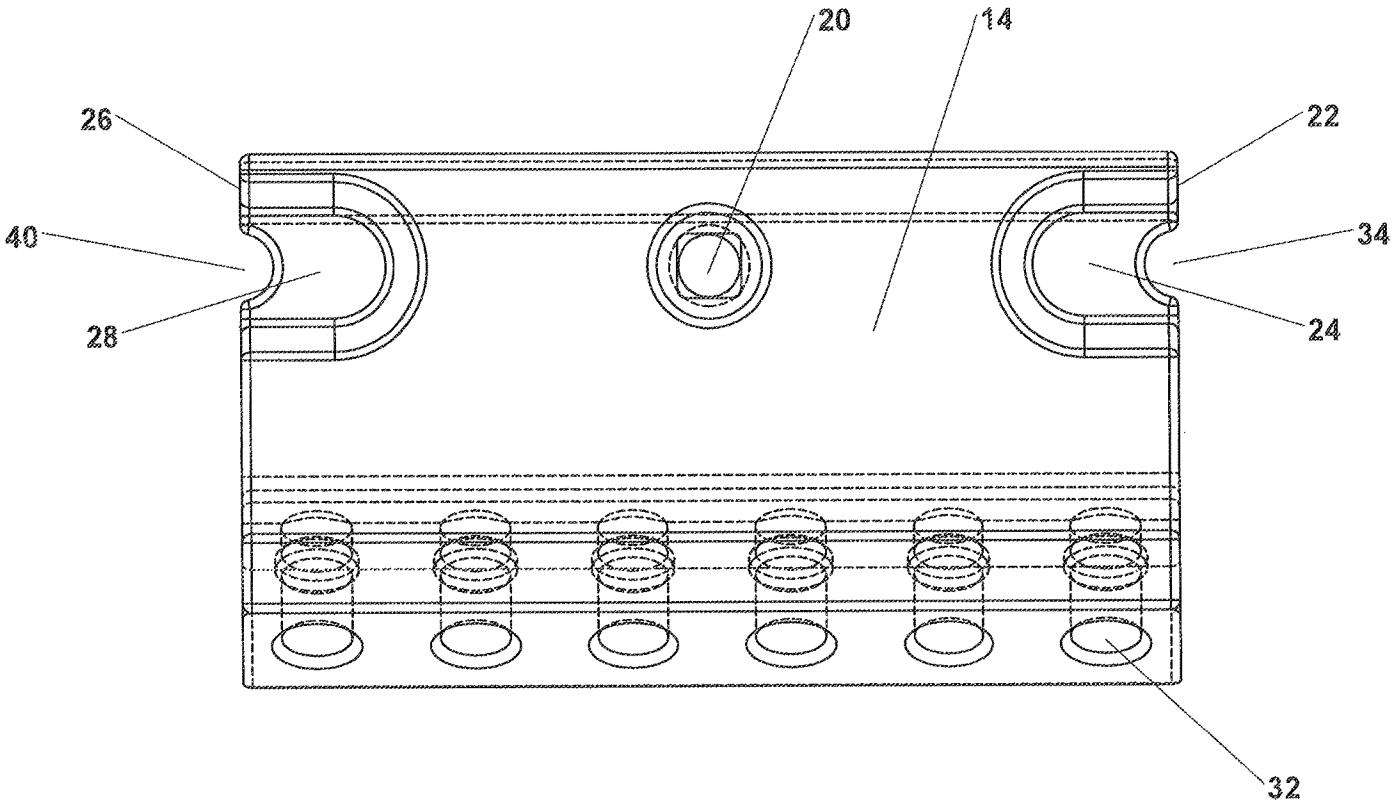
FIG. 4 in a front plan view, illustrates the grader segment of the sectional grader system of FIG. 1.
Figure 5:
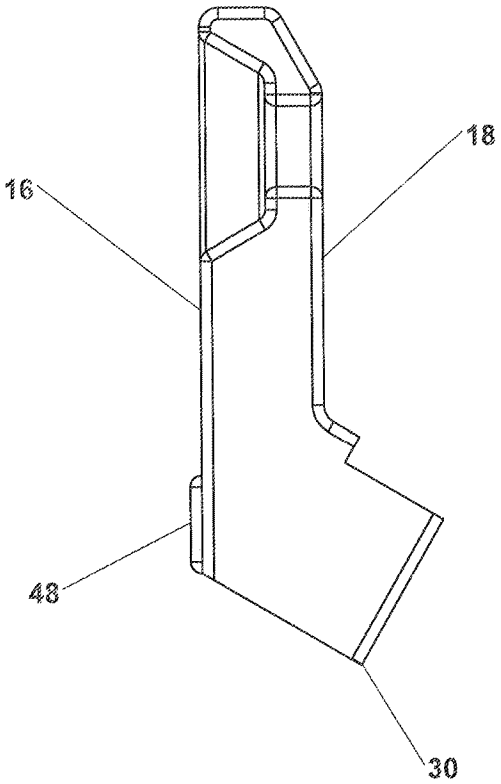
FIG. 5 in a side view, illustrates the grader segment of the sectional grader system of FIG. 1.
Figure 6:
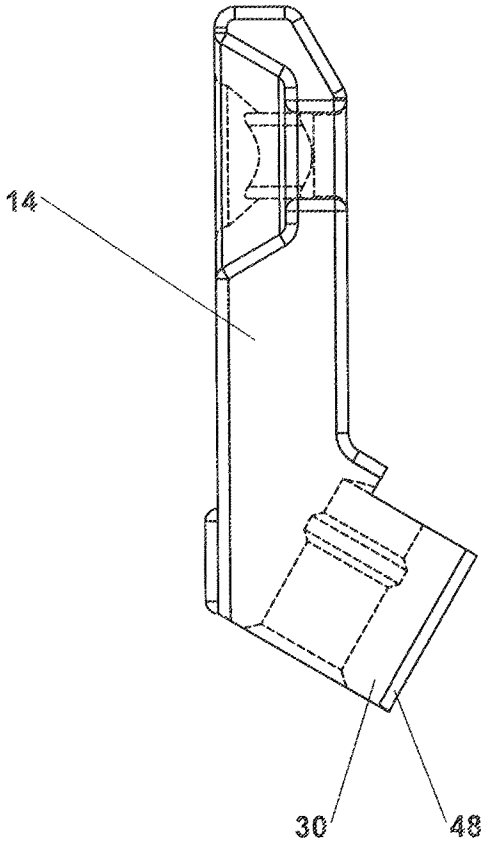
FIG. 6 in a side view, illustrates the grader segment of the sectional grader system of FIG. 1.
Figure 7:
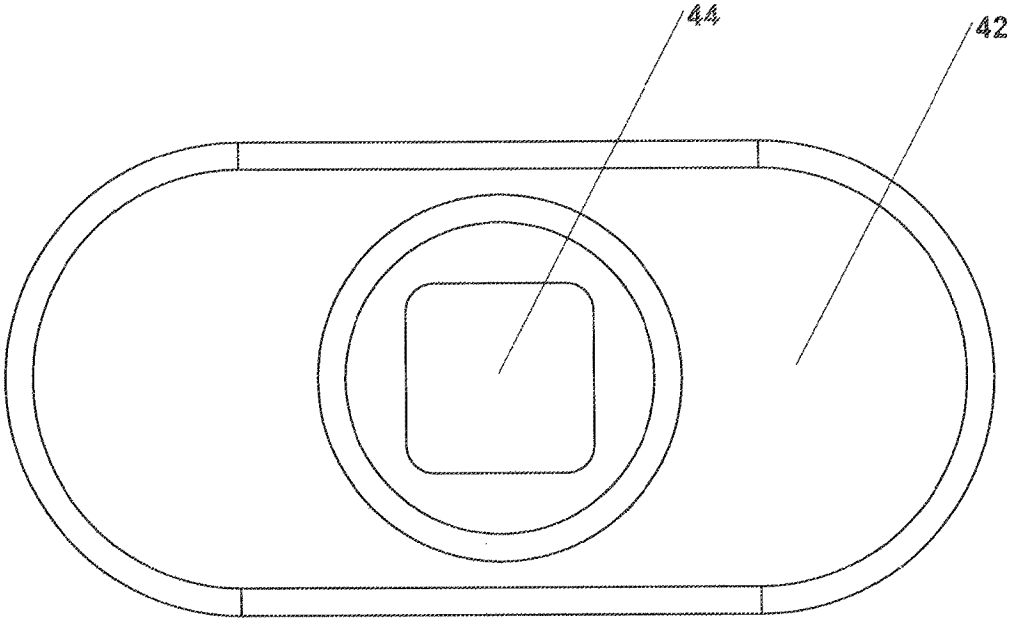
FIG. 7 in a front plan view, illustrates the bridge segment of the sectional grader system of FIG. 1.
Figure 8:
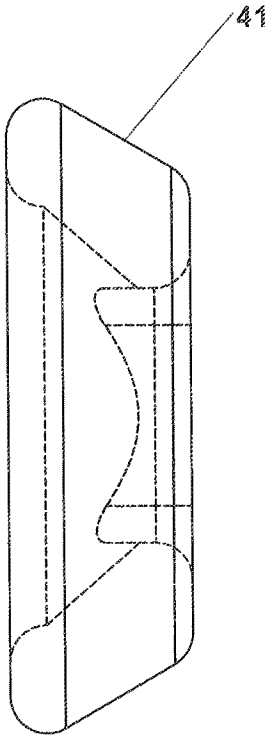
FIG. 8 in a side view, illustrates the bridge segment of the sectional grader system of FIG. 1.
Figure 9:
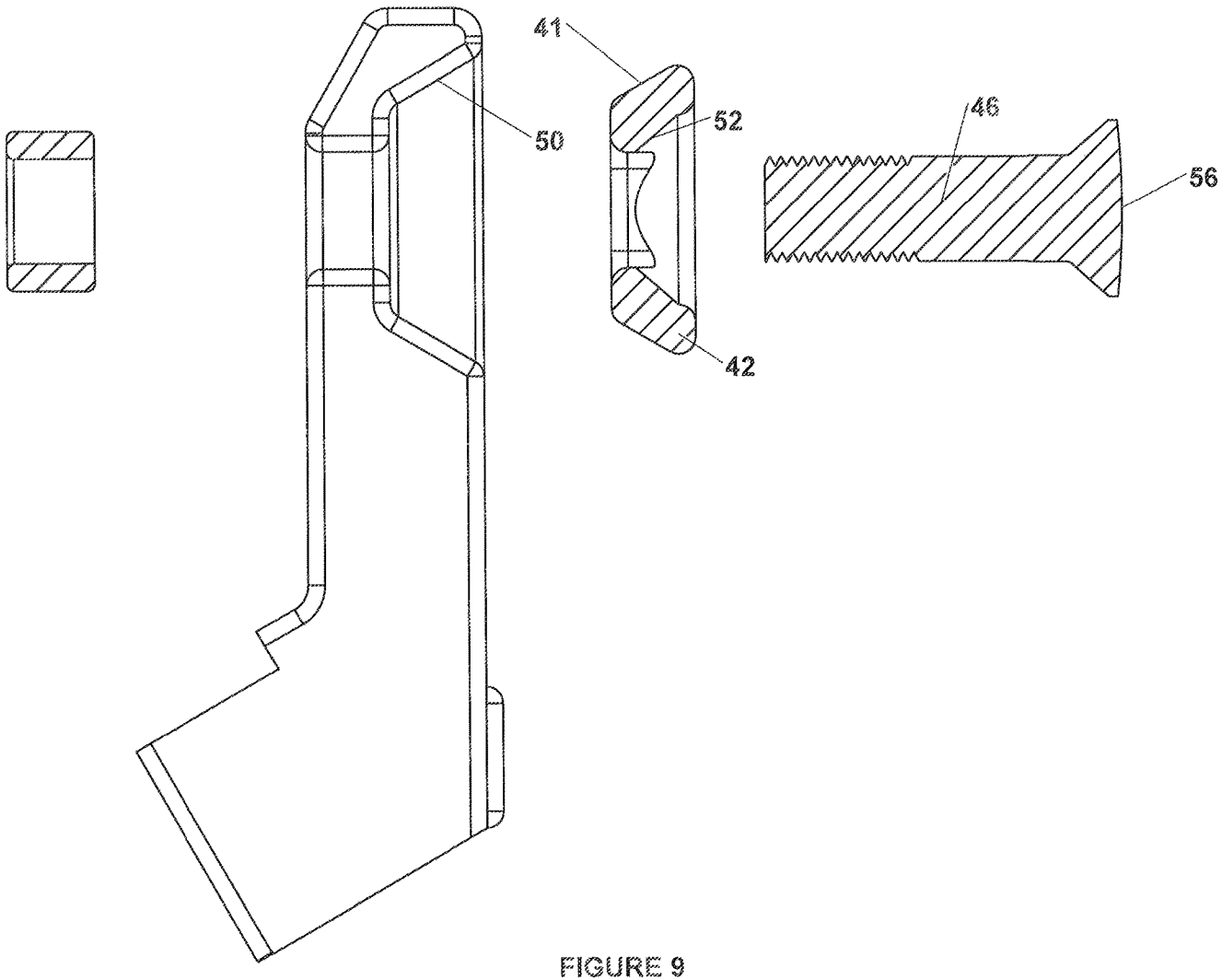
FIG. 9 in an exploded cross-sectional view, illustrates the sectional grader system of FIG. 1.
Figure 10:
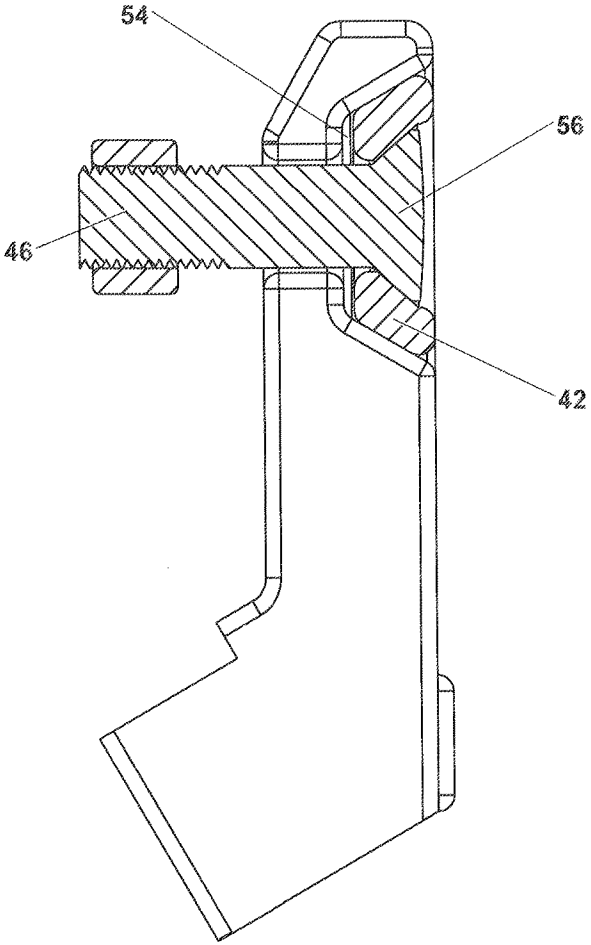
FIG. 10 in a cross-sectional view illustrates the sectional grader system of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1 to 10, there is illustrated a sectional grader system 10 for a mold board 12 in accordance with a preferred embodiment of the present invention. The sectional grader system 10 for a mold board 12 includes a plurality of abutting grader segments 14 for detachable connection to the mold board 12. Each grader segment 14 includes a front face 16, a back face 18, a first bolt hole aperture 20, a right edge 22 having a first recessed section 24, a left edge 26 having a second recessed section 28, and a lower edge 30 having a plurality of spaced sockets 32.

The first recessed section 24 may be adapted to accommodate a first portion 34 of a second bolt hole aperture 36. The second recessed section 28 of an adjacent grader segment 38 may be adapted to accommodate a second portion 40 of the second bolt hole aperture 36.

The sectional grader system 10 may further include a bridge segment 42 having tapered sides 41 that are adapted to engage the first recessed section 24 and the second recessed section 28 of the adjacent grader segment 38 in flush mount. The bridge segment 42 may have a third bolt hole aperture 44 whereby the third bolt hole aperture 44 aligns with the first and second portions, 34 and 40 respectively, of the second bolt hole aperture 36 for receiving a bolt connector 46 for mounting the plurality of grader segments 14 to the mold board 12.

The grader segment 14 and the bridge segment 42 may each be forged from a single piece of steel. The lower edge 30 may include an extra wear edge 48 by hardening the surface with tungsten carbide. Additional hardening aids to reduce the pitting and corrosion of the surface of the grader segment 14 may also be included.

Recessing the bridge segment 42 into the first and second recessed sections, 24 and 28 respectively, allows the bridge segment 42 to seat properly between the grader segment 14 and the adjacent grader segment 38 thereby providing a flush profile or mount.

The flush mount and profile of the bridge segment 42 is achieved by tapered sides 50 of the first and second recessed sections 24 and 28 of the grader segment 14 that match the tapered sides of the bridge segment 42. More specifically the third bolt hole aperture 44 of the bridge segment 42 may also be tapered 52 to help guide the bolt connector 46 into the third bolt hole aperture 44.

Furthermore the proper positioning of the bridge segment 42 within the first and second recessed sections 24 and 28 of the grader segments 14 is ensured by a positioning gap 54 that helps align adjacent grader segments 38 when the connector bolt 46 and specifically the head 56 of the connector bolt 46 is engaged. Without the positioning gap 54 to provide sufficient space to achieve proper alignment, the bridge segment 42 will bottom out within the second and third bolt hole apertures 36 and 44 respectively, and the grader segments 14 will not align properly.

More specifically the tapered sides 50 of the first and second recessed sections 24 engage or mate with the tapered sides 41 of the bridge segment 42 prior to the bridge segment 42 bottoming out into the second recessed section 24 and 28, thereby creating the positioning gap 54. The positioning gap 54 ensure that the mating of the tapered sides 41 and 50 occurs first and allows for the correct alignment of the grader segments Correct alignment impedes the rotation or potential axial rotation of the grader segment 14 about the first bolt hole aperture 20 and a fastener 59 so that the fastener 59 does not unscrew and the grader segment 14 disengages from the mold board 12.

If the grader segments 14 that are connected to one another, fall out of alignment, any associated cutting tool positioned within the sockets 32 will also be out of alignment. The surface engaging profile of the cutting tools will then engage the surface unevenly.

In operation, the grader segment 14 may be positioned to abut the adjacent grader segment 38. The right edge 22 and the first recessed section 24 of grader segment 14 therefore abuts the left edge 26 and the second recessed section 28 so that the first portion 34 of the second bolt hole aperture 36 abuts the second portion 40 of the second bolt hole aperture 36 thereby forming the entire second bolt hole aperture 36.

The bridge segment 42 may then be positioned within the second and first recessed sections 24 and 28 creating the gap 54. The bolt connector 46 may then engage the tapered sides 52 of the third bolt hole aperture 44 and then pass through the second bolt hole aperture 36, the positioning gap 54 ensuring the correct alignment of the grader segment 14 to the adjacent grader segment 38. Assembled the grader segment 14 weighs approximately 12 kilograms, which allows for easy instalment by a single person. Each individual grader segment may be mounted on the mold board 12 through the first bolt hole aperture 20 with the fastener 59.

Figure 11:
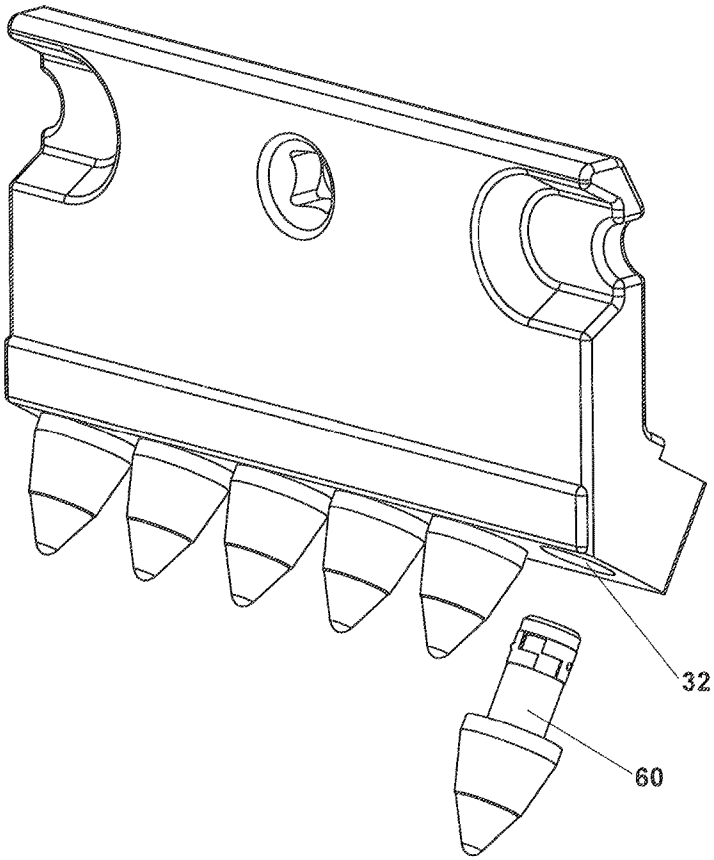
FIG. 11 in a perspective view, illustrates a sectional grader system for a mold board in accordance with another preferred embodiment of the present invention.
Figure 12:
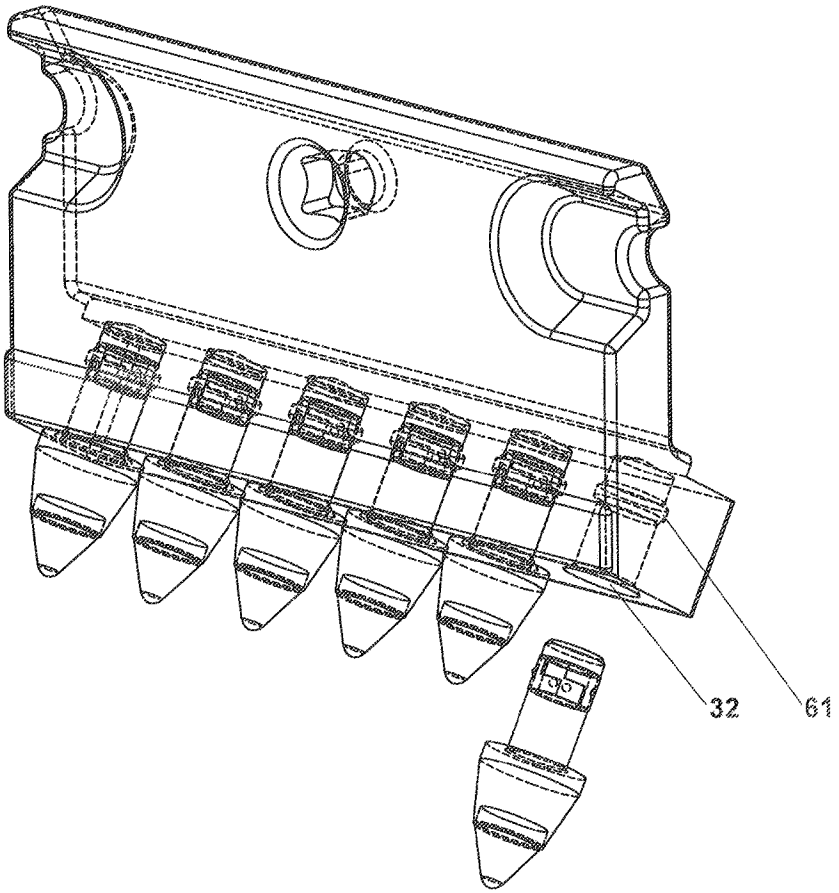
FIG. 12 in a perspective view, illustrates the sectional grader system of FIG. 11.
Figure 13:
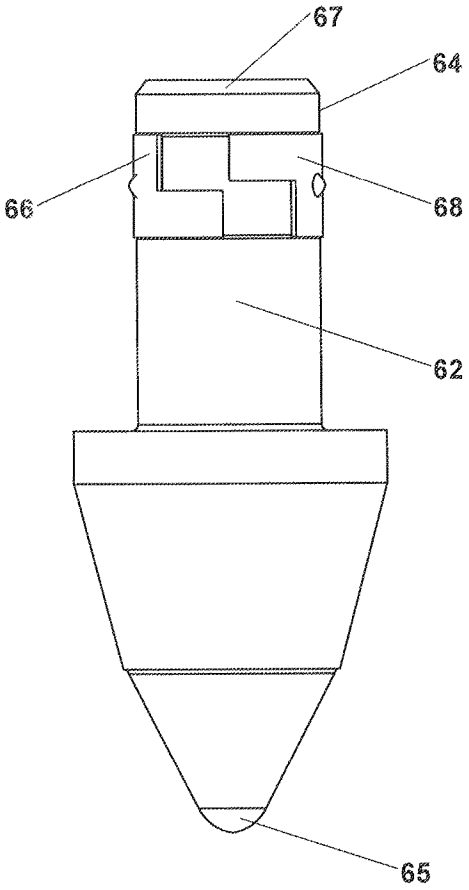
FIG. 13 in a front plan view, illustrates the rotatable cutting tool of the sectional grader system of FIG. 11.
Figure 14:
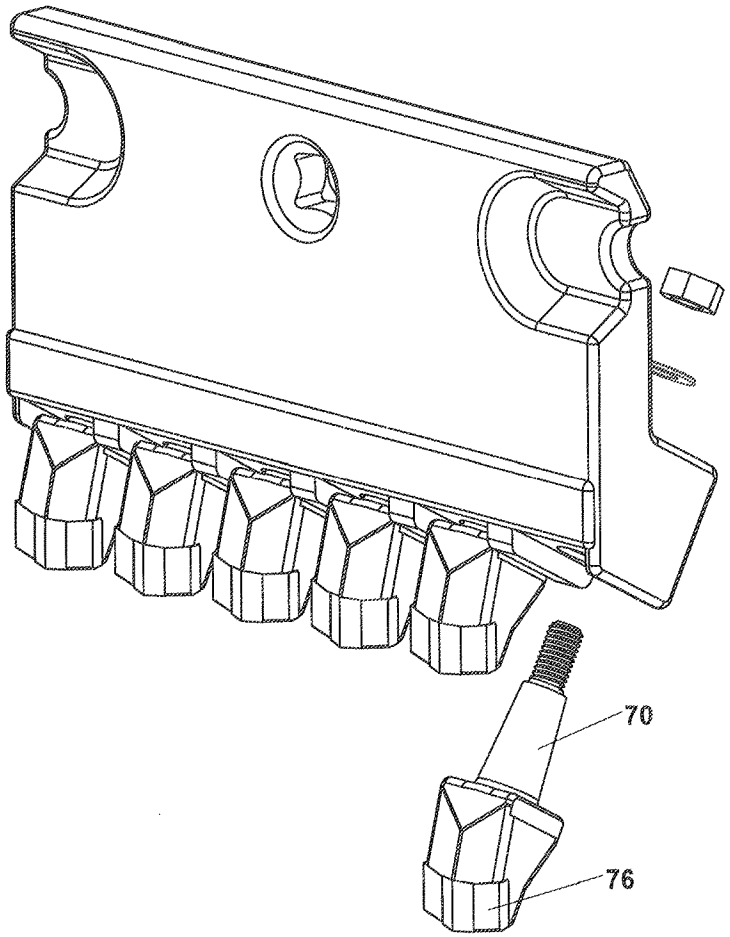
FIG. 14 in an exploded perspective view, illustrates a sectional grader system for a mold board in accordance with another preferred embodiment of the present invention.
Figure 15:
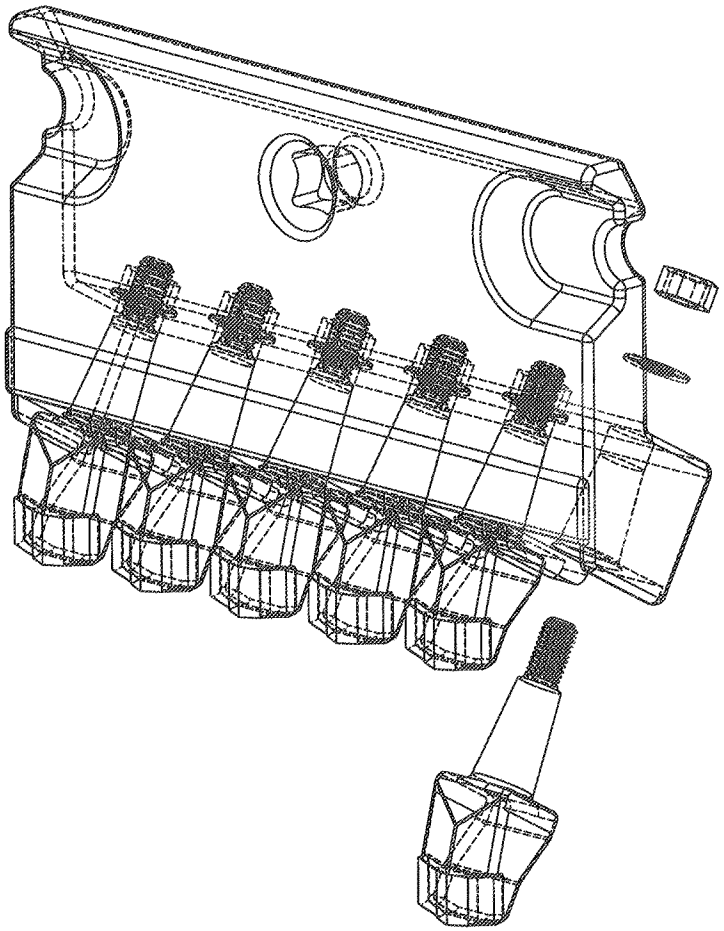
FIG. 15 in an exploded perspective view, illustrates the sectional grader system of FIG. 14.
Figure 16:
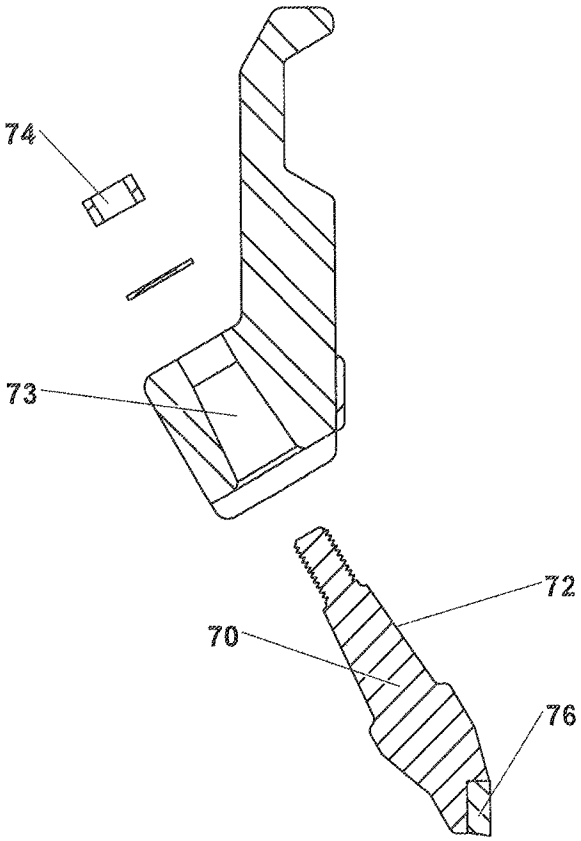
FIG. 16 in an exploded cross-sectional, illustrates the non-rotatable cutting tool of the sectional grader system of FIG. 14.
Figure 17:
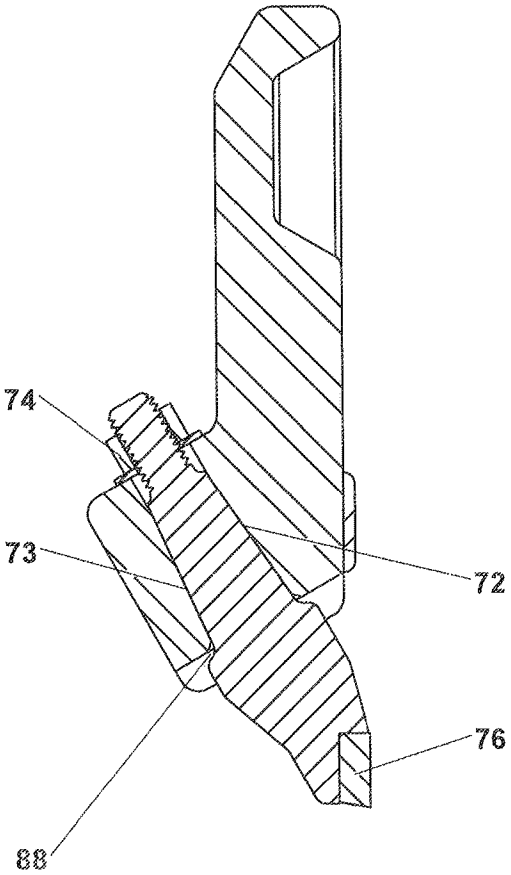
FIG. 17 in a cross-sectional view illustrates the sectional grader system of FIG. 14.
Figure 18:
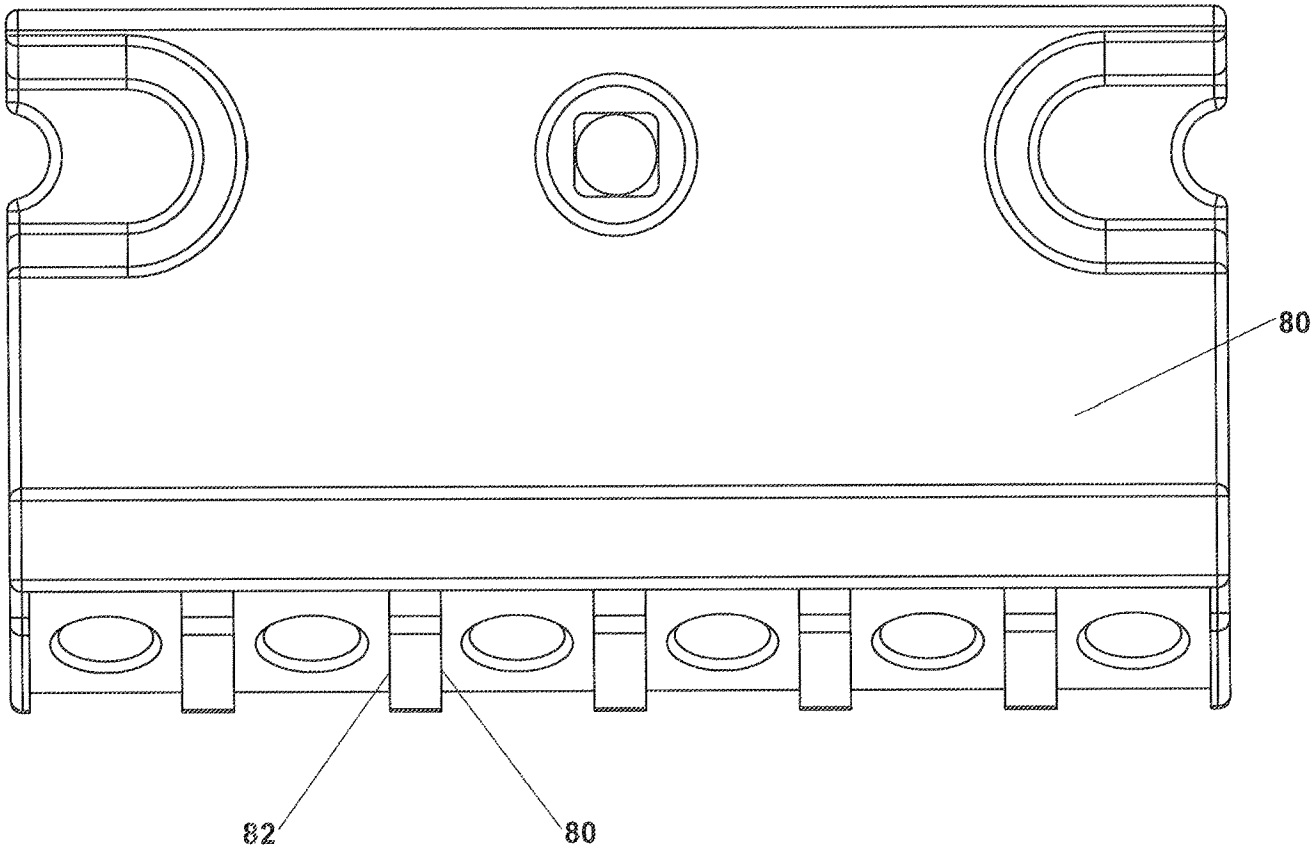
FIG. 18 in a front plan view illustrates grader segment of the sectional grader system of FIG. 14.
Figure 19:
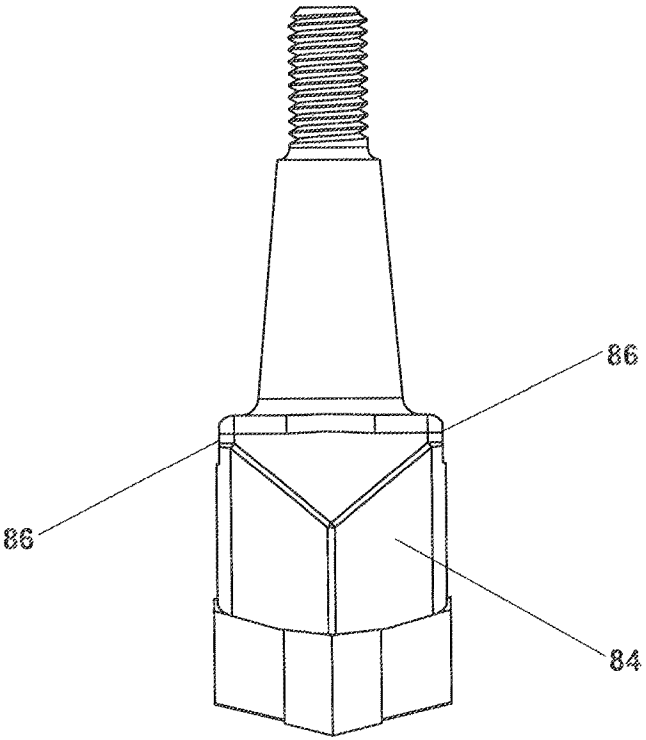
FIG. 19 in a front plan view illustrates cutting tool of the sectional grader system of FIG. 14.

Referring to FIGS. 11 to 13 there is illustrated in another embodiment the present invention the sectional grader system 10 further including a plurality of removable, cutting tools 60. Each removable cutting tool 60 may engage a respective socket 32. In the instant embodiment, the socket 32 may be further defined as cylindrical straight diameter hole having an internal groove 61. Each cutting tool 60 may have a body portion 62 with an upper end 64 having spring fit retention means 66 for releasably retaining the body portion 62. The body portion 62 may further include a lower cutting tip 65 for engaging a surface.

The upper end 64 may be further defined as having a flat end 67 with the spring fit retention means 66 namely a spring loaded retainer clip 68. The body portion 62 may have cylindrical straight diameter to allow the cutting tool 60 to slide into the socket 32. The spring loaded retainer clip 68 may engage with the internal groove 61 to retain the cutting tool 60 within the socket 32 while still allowing the cutting tool 60 to rotate. The cutting tool 62 may rotate fully within the socket 32 thereby allowing the cutting tool 60 to be self-sharpening while being retained in the socket 32.

Referring to FIGS. 14-19 there is illustrated in another embodiment of the present invention the sectional grader system 10 where the cutting tool 70 has a tapered body portion 72 adapted to be received by a tapered or conical socket 73 in grader segment 80. The tapered body portion 72 may be further defined as having an engagement head 84.

The engagement head 84 may include flat mating surfaces 86 on either side of the engagement head 84. The grader segment 80 may further include multiple tapered sockets 73 separated from one another by adjacent flat walls 82. When inserted into the tapered socket 73, the flat mating surfaces 86 engage the adjacent flat walls 82 of the grader segment 80. The engagement of the flat mating surfaces 86 of the engagement head 84 with the adjacent flat walls 82 prevents the rotation of the cutting tool 70 within the tapered socket 73. Similar to positioning gap 54, the mating of the tapered surfaces of the tapered socket 73 and the tapered body portion 72 is ensured by a positioning gap 88 which allows for the cutting tool 70 to engage with the tapered socket 73 correctly thereby ensuring correct installation.

The upper end 72 may be threaded to accept a nut 74 to secure the cutting tool 70 within the tapered socket 73. The tapered body portion 72 may further include a lower cutting tip 76 that engages the surface. The tapered body portion 72 slips easily into the tapered socket 73, and once secured by the nut 74 does not rotate.

The harsh environment experienced by the cutting tool typically results in the cutting tools 60 becoming encrusted and frozen in the socket 32. Specifically the dirt, dust and salt work into the tapered socket 73 and corrode the cutting tools 70 into the socket. Replacement of these cutting tools 70 require costly maintenance and down time for the vehicle. The tapered body portion 72 allows for easy removal, as the cutting tool 70 slides out of the tapered socket 73.

Other variations and modifications of the invention are possible. All such modifications or variations are believed to be within the sphere and scope of the invention as defined by the claims appended hereto.

I claim:

1. A sectional grader system for a mold board comprising:

a plurality of abutting grader segments for detachable connection to the mold board, each grader segment having, a front face, a back face, a first bolt hole aperture, a right edge having a first recessed section, a left edge having a second recessed section, and a lower edge having a plurality of spaced sockets, wherein the first recessed section is adapted to accommodate a first portion of a second bolt hole aperture, and the second recessed section of an adjacent grader segment is adapted to accommodate a second portion of the second bolt hole aperture; and (b) a bridge segment adapted to engage the first recessed section and the second recessed section of the adjacent grader segment in flush mount, the bridge segment having a third bolt hole aperture whereby the third bolt hole aperture aligns with the first and second portions of the second bolt hole aperture for receiving a bolt connector for mounting the plurality of grader segments to the mold board.

2. A sectional grader system for a mold board as claimed in claim 1 wherein the first and second recessed sections of the grader segments have tapered sides.

3. A sectional grader system for a mold board as claimed in claim 2 wherein the bridge segment has tapered sides for engagement with the tapered sides of the first and second recessed sections of the grader segments and the creation of a positioning gap.

4. A sectional grader system for a mold board as claimed in claim 3 wherein the third bolt hole aperture has tapered sides.

5. A sectional grader system for a mold board as claimed in claim 1 wherein the lower edge of the grader segment further includes a wear edge of tungsten carbide.

6. A sectional grader system for a mold board comprising:

(a) a plurality of abutting grader segments for detachable connection to the mold board, each grader segment having,
  (i) a front face,
  (ii) a back face,
  (iii) a first bolt hole aperture,
  (iv) a right edge having a first recessed section,
  (v) a left edge having a second recessed section, and
  (vi) a lower edge having a plurality of spaced sockets,
  wherein the first recessed section is adapted to accommodate a first portion of a second bolt hole aperture, and the second recessed section of an adjacent grader segment is adapted to accommodate a second portion of the second bolt hole aperture;

(b) a bridge segment adapted to engage the first recessed section and the second recessed section of the adjacent grader segment in flush mount, the bridge segment having a third bolt hole aperture whereby the third bolt hole aperture aligns with the first and second portions of the second bolt hole aperture for receiving a bolt connector for mounting the plurality of grader segments to the mold board; and (c) a plurality of removable, rotatable cutting tools each adapted engage a respective socket, each cutting tool having:
  (i) a body portion with an upper end having spring fit retention means for releasably retaining the body portion, and
  (ii) a lower cutting tip for engaging a surface.

7. A sectional grader system for a mold board as claimed in claim 6 wherein the first and second recessed sections of the grader segments have tapered sides.

8. A sectional grader system for a mold board as claimed in claim 7 wherein the bridge segment has tapered sides for engagement with the tapered sides of the first and second recessed sections of the grader segments and the creation of a positioning gap.

9. A sectional grader system for a mold board as claimed in claim 8 wherein the third bolt hole aperture has tapered sides.

10. A sectional grader system for a mold board as claimed in claim 9 wherein the lower edge of the grader segment further includes a wear edge of tungsten carbide.

11. A sectional grader system for a mold board comprising:

(a) a plurality of abutting grader segments for detachable connection to the mold board, each grader segment having,
  (i) a front face,
  (ii) a back face,
  (iii) a first bolt hole aperture,
  (iv) a right edge having a first recessed section,
  (v) a left edge having a second recessed section, and
  (vi) a lower edge having a plurality of spaced sockets separated from one another by adjacent flat walls,
  wherein the first recessed section is adapted to accommodate a first portion of a second bolt hole aperture, and the second recessed section of an adjacent grader segment is adapted to accommodate a second portion of the second bolt hole aperture;

(b) a bridge segment adapted to engage the first recessed section and the second recessed section of the adjacent grader segment in flush mount, the bridge segment having a third bolt hole aperture whereby the third bolt hole aperture aligns with the first and second portions of the second bolt hole aperture for receiving a bolt connector for mounting the plurality of grader segments to the mold board; and (c) a plurality of removable, non-rotatable cutting tools each adapted engage a respective tapered socket, each cutting tool having:
  (i) a body portion having a tapered diameter and a threaded upper end adapted to pass through the lower edge of the grader segment to the back face for releasable securement with a fastener, and
  (i) a lower cutting end for engaging a surface.

12. A sectional grader system for a mold board as claimed in claim 11 wherein the first and second recessed sections of the grader segments have tapered sides.

13. A sectional grader system for a mold board as claimed in claim 12 wherein the bridge segment has tapered sides for engagement with the tapered sides of the first and second recessed sections of the grader segments and the creation of a positioning gap.

14. A sectional grader system for a mold board as claimed in claim 13 wherein the third bolt hole aperture has tapered sides.

15. A sectional grader system for a mold board as claimed in claim 14 wherein the lower edge of the grader segment further includes a wear edge of tungsten carbide.

16. A sectional grader system for a mold board as claimed in claim 13 wherein the body portion further includes flat mating surfaces for engagement with adjacent flat walls to prevent rotation of the cutting tool.

* * * * *